United States Patent [19]

McNeely

[11] Patent Number: 4,480,250

[45] Date of Patent: Oct. 30, 1984

[54] CREDIT CARD CARRIER WITH ALARM

[76] Inventor: Charles D. McNeely, 3060 Killian Rd., Uniontown, Ohio 44685

[21] Appl. No.: 325,235

[22] Filed: Nov. 27, 1981

[51] Int. Cl.[3] ..... G08B 7/00; G08B 21/00

[52] U.S. Cl. ..... 340/568

[58] Field of Search ..... 340/568

[56] References Cited

U.S. PATENT DOCUMENTS 3,959,789 5/1976 McGahee ..... 340/568

*Primary Examiner*—Glen R. Swann, III

*Attorney, Agent, or Firm*—Oldham, Oldham, Hudak & Weber Co.

[57] ABSTRACT

A credit card carrier includes a pair of flaps foldable upon each other. Each of the flaps carries clip switches adapted for receiving credit cards therein. The clip switches are arranged in parallel interconnection with each other, and in series interconnection between an alarm and a battery. When a credit card is missing from one of the clip switches, the circuit between the battery and the alarm is completed and the alarm is energized. The flap also includes a proximity switch such that interconnection between the battery and the alarm is disabled until the flaps are folded onto each other.

8 Claims, 2 Drawing Figures

CREDIT CARD CARRIER WITH ALARM

TECHNICAL FIELD

The invention herein resides in the art of security devices and is more particularly related to such devices for wallets and the like. More specifically, the invention pertains to a wallet-like structure adapted for receiving a plurality of credit cards, and including an alarm to signal the absence of a credit card.

BACKGROUND ART

Credit cards or "plastic money" have become increasingly popular in the not-too-distant past. Most consumers now have at their disposal a significant number of credit cards, allowing them to make purchases of goods and services at any of a number of retail outlets or facilities. Normally, such persons carry their credit cards in a separate portion of their wallet and, to satisfy a charge, remove the appropriate card from their wallet and deliver the same to a sales clerk so that the charge may be entered on the proper account. It is not uncommon for the customer then to leave the sales establishment without recovering his card and returning it to his wallet. The loss of the card is generally not detected until its use is again required.

Applicant is unaware of any wallet or credit card carrier which includes means for signalling the absence of a credit card. There are, however, known security devices incorporated with wallets, purses, and the like, to prevent the same from being stolen. Applicant is aware of other devices for securing specific articles. For example, U.S. Pat. No. 3,439,359, presents a structure wherein the state of balance of a Wheatstone bridge is used to determine when an article has been tampered with. In similar fashion, U.S. Pat. No. 4,155,079, provides a structure wherein a mercury switch is used to determine or sense a change of attitude or position and to accordingly sound an alarm comprising an audio oscillator. In U.S. Pat. No. 3,701,140, an alarm circuit is maintained within a purse such that any sudden jerking motion of the purse actuates the alarm circuit. In similar fashion, U.S. Pat. No. 3,938,126, a short circuit provided through the handle or closure device of the purse acts to prevent theft by either cutting of the purse handle or unauthorized opening of the closure device. U.S. Pat. No. 3,534,358, teaches the utilization of a metallic card in books or the like, such card actuating an alarm when passed by a detection area. Finally, U.S. Pat. No. 3,930,249, teaches a wallet having an electronic circuit which emits an audible alarm when the wallet is wrongfully removed from the owner's purse or pocket.

While all of the foregoing prior art deals with security devices of sorts, none of this known art teaches a means for determining the absence of a credit card from a preordained receptacle. Indeed, there appears to be a void in the art of any structure adapted for alarming an owner as to the absence of such a card.

DISCLOSURE OF INVENTION

In light of the foregoing, it is an object of an aspect of the invention to present a credit card holder which includes a circuit for determining the absence of a credit card from the holder.

Another object of an aspect of the invention is to provide a credit card holder in which the absence of a card from the holder operates to sound an alarm only when the holder has been prepared for return to the user's purse or pocket.

Still a further object of an aspect of the invention is to provide a credit card holder which is simple and inexpensive in design and construction, while being extremely reliable in operation.

The foregoing and other objects of the invention which will become apparent as the detailed description proceeds are achieved by a credit card carrier, comprising a plurality of receptacles for receiving and maintaining cards; sensing means associated with each receptacle for determining the presence or absence of a card therein; and alarm means operatively connected to each said sensing means for emitting a signal upon the absence of a card from any of said receptacles.

BRIEF DESCRIPTION OF DRAWING

For a complete understanding of the objects, technique, and structure of the invention, reference should be had to the following detailed description and accompanying drawing wherein.

BEST MODE FOR CARRYING OUT THE INVENTION

Figure 1:
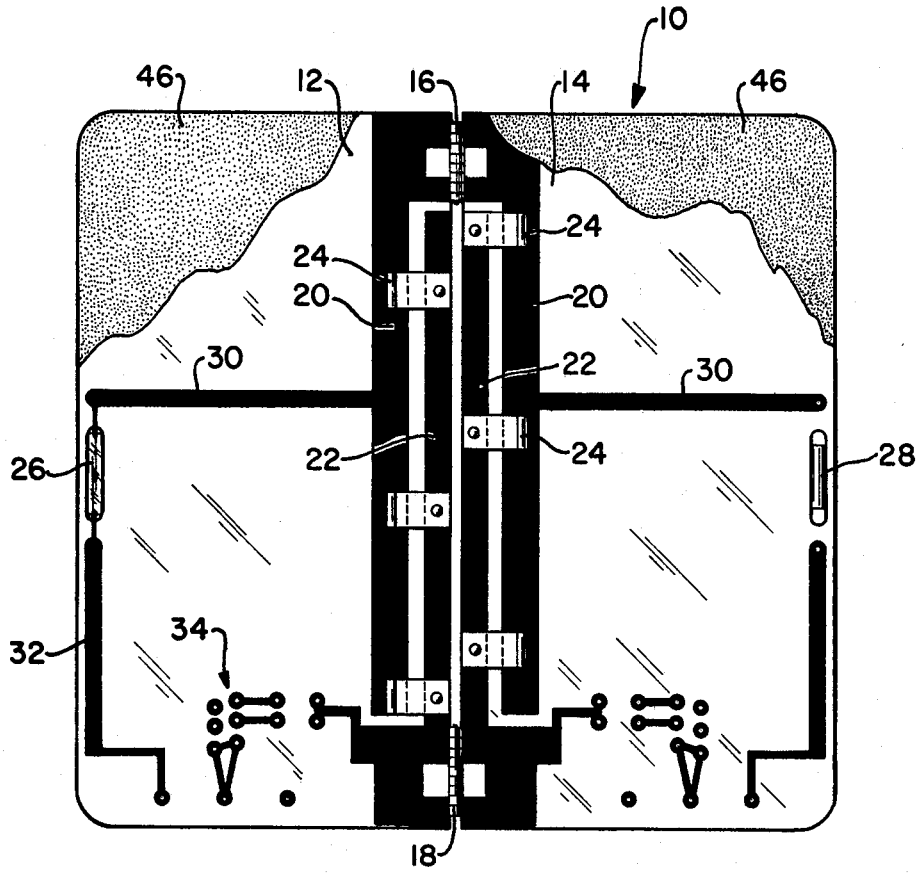
FIG. 1 is a top plan view of the credit card carrier of the invention having the cover thereof substantially removed.

Referring now to the drawing and more particularly FIG. 1, it can be seen that the credit card carrier of the invention is designated generally by the numeral 10. Side flaps or panels 12,14 are hingedly interconnected at the top and bottom thereof by means of hinges 16,18. The flaps 12,14 can be constructed of fiberboard or other simlar material and, indeed, it is contemplated that the flaps 12,14 could be of unitary construction, folded about a crease or score line rather than the hinges 16,18.

Metallic or other electrically conductive strips 20,22 characterize each of the flaps 12,14. The strips 20 of each of the flaps 12,14 communicate with each other through the hinge 16, while the strips 22 are in electrical communication via the hinge 18. In the embodiment where there are no such hinges, it will be appreciated that the strips 20,22 of the flaps 12,14 would respectively communicate with each other as just described by means of other suitable physical interconnection, such as being masked as respective unitary strips.

A plurality of clips 24 bridge the strips 20,22 of the respective flaps 12,14, as shown. The clips 24 are fixedly secured to the strips 22, while being spring-biased toward engagement witn the strips 20. These spring-biased clips 24 are adapted for receiving the edges of credit cards thereunder, with the spring-biased nature of the clips securing and retaining the associated cards, acting as receptacles therefor.

As shown, the flap 12 has the switch portion of a Reed switch 26 thereon, with the associated magnet 28 being positioned on the flap 14. As is known to those skilled in the art, the Reed switch 26,28 acts as a proximity switch such that when the magnet 28 is brought into juxtaposition with the switch portion 26, such switch portion closes to complete an electrical path. This electrical path is illustrated as the conductive strips 30,32, which strips act to interconnect the conductive strips 20,22 with circuitry shown generally by the numeral 34 in FIG. 1, and discussed in detail directly below with respect to FIG. 2.

Figure 2:
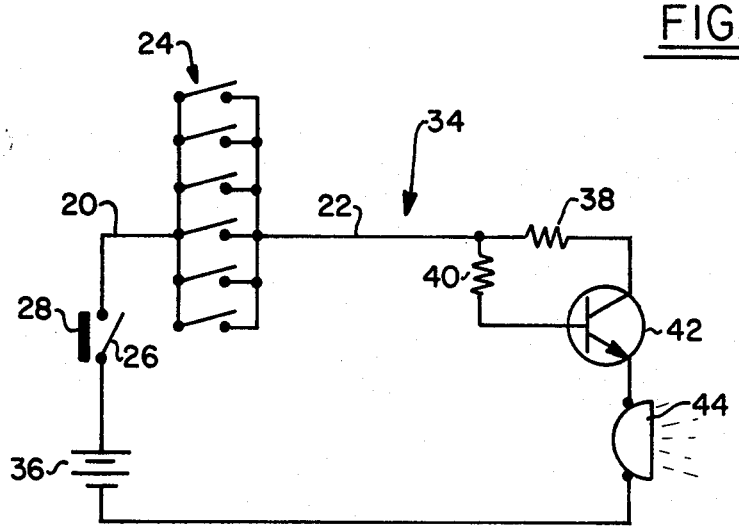
FIG. 2 is a circuit schematic of the alarm circuitry of the invention.

With reference now to FIG. 2, it can be seen that the circuitry 34 includes the proximity or Reed switch 26,28, and the array of clips 24. Also included is a battery or power source 36 which can be of the type typically used for hearing aids, digital watches, and the like. When the Reed switch 26 and at least one of the clips 24 are closed, the battery 36 is operative for energizing an audible alarm 44 through a transistor 42. The transistor 42 has appropriate gain provided via the resistors 38,40, arranged in standard fashion.

With reference now to FIGS. 1 and 2, in tandem, it will be appreciated that when the flaps 12,14 are folded upon each other, the magnet 28 comes into sufficient proximity to the switch portion 26 of the proximity switch 26,28 to close the same. The circuitry 34 is, at that time, enabled. Should a credit card be missing from beneath one of the clips 24, such clip is closed to interconnect the conductive strips 20,22 and to thereby provide power to the alarm 44 through the transistor 42. The alarm then sounds, advising the user that he has closed his card carrier without a full complement of cards therein.

It should at this time be noted that the flaps 12,14 would typically be covered by a leather, vinyl, or other appropriate covering 46 which has been substantially removed in FIG. 1 for illustrative purposes only. An insulative strip not shown may also be included between the flaps 12,14 to prevent shorting of the clips 24 with conductive strips 20 when such flaps are closed. Of course, the covering 46 could be designed to achieve this function. It will also be noted that the flaps 12,14 are mirror images of each other, having been generated from the same silk screen mask. Quite obviously, only the lands of one of the flaps 12,14 need be populated with the circuitry 34, such being the flap 12 in FIG. 1. Similarly, the conductive strips 30,32 are functional only in the flap 12. Should one desire, a silk screen for the flaps 14 could be generated absent the conductive strips 30,32 or the provision of lands for the circuitry 34.

Finally, it should be appreciated that the card carrier 10, having an appropriate cover 46 thereon, can also include appropriate compartments for currency, pictures, change, and the like, such being well within the purview of one skilled in the art and not elaborated upon herein.

With an appreciation now of the structure of the invention, the use thereof will be considered. As shown in FIG. 1, the card carrier 10 is adapted for receiving six credit cards. It is important that all of the clips 24 have a card maintained between the spring-biased end and the conductive strip 20. Accordingly, should the user have less than six credit cards, the remaining clips can be held open by means of a blank card provided for that purpose. The user, wanting to make a credit card purchase, merely removes the card carrier 10 from his or her pocket or purse, opens the same, and removes the appropriate card. With the flaps 12,14 being open, the proximity switch 26,28 is open, and the circuitry 34 is disabled. Accordingly, the alarm 44 does not sound. After the clerk is finished with the card, the user reinserts it under the appropriate clip 24 and closes the card carrier 10, the magnet 28 then cloosing the switch portion 26 of the proximity switch 26,28. However, with all the clip switches 24 being open, no alarm sounds.

In the situation above, had the user determined to leave the store before having replaced his credit card under the appropriate clip 24, the alarm 44 would have sounded. This would have occurred since one of the clip switches 24 would have been closed and, upon closure of the proximity switch 26,28, power would have been applied through the transistor 42 to the alarm 44. It will be noted that the clip switches 24 are in parallel interconnecton with each other, but in series connection between the battery 36 and the alarm 44, such that only one clip switch 24 need be closed to actuate the alarm.

Thus it can be seen that the objects of the invention have been satisfied by the structure presented hereinabove. While in accordance with the patent statutes only the best mode and preferred embodiments of the invention have been presented and described in detail, it is to be understood that the invention is not limited thereto or thereby. Consequently, for an appreciation of the true scope and breadth of the invention reference should be had to the appended claims.

What is claimed is:

1. A card carrier, comprising:

a plurality of receptacles for receiving and maintaining cards;

sensing means associated with each receptacle for determining the presence or absence of a card therein;

alarm means operatively connected to each said sensing means for emitting a signal upon the absence of a card from any of said receptacles; and a pair of flaps, foldable onto each other, said flaps receiving said receptacles, sensing means, and alarm means, wherein said flaps include switch means in operative interconnection with said alarm means disabling said alarm means when said flaps are open.

2. The card carrier according to claim 1 wherein said alarm means comprises an alarm in series interconnection with a battery, said sensing means, and said switch means.

3. The card carrier according to claim 2 wherein each said receptacle comprises a clip switch, said clip switches being in parallel interconnection with each other, and in series interconnection with said alarm and battery.

4. The card carrier according to claim 3 wherein said sensing means comprises electrically conductive strips interconnected between opposite sides of each said clip switch.

5. The card carrier according to claim 1 wherein said switch means comprises a proximity switch.

6. A card carrier, comprising:

a pair of flaps foldable upon each other;

clip switches carried by each of said flaps and being adapted for receiving cards therein;

an alarm;

circuit means interconnecting said clip switches and said alarm for activating said alarm upon the closure of any said clip switch; and wherein said flaps include a proximity switch, enabling said circuit means only when said flaps are folded upon each other.

7. The card carrier according to claim 6 wherein said clip switches are in parallel connection with each other and in series interconnection between a battery and said alarm.

8. The card carrier according to claim 7 wherein said clip switches are spring-biased across electrically conductive strips comprising a portion of said circuit means.

* * * * *